US007798614B2

(12) United States Patent
Chikamoto et al.

(10) Patent No.: US 7,798,614 B2
(45) Date of Patent: Sep. 21, 2010

(54) INKJET HEAD

(75) Inventors: Tadanobu Chikamoto, Nagoya (JP); Atsushi Hirota, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 794 days.

(21) Appl. No.: 11/330,249

(22) Filed: Jan. 12, 2006

(65) Prior Publication Data

US 2006/0171823 A1 Aug. 3, 2006

(30) Foreign Application Priority Data

Jan. 14, 2005 (JP) ..... 2005-007628

(51) Int. Cl.
*B41J 2/045* (2006.01)

(52) U.S. Cl. ..... 347/68; 347/71

(58) Field of Classification Search ..... 347/71
See application file for complete search history.

(56) References Cited

U.S. PATENT DOCUMENTS

| | | | | |
|---|---|---|---|---|
| 5,581,288 | A * | 12/1996 | Shimizu et al. | 347/87 |
| 2003/0156156 | A1 | 8/2003 | Sakaida et al. | |
| 2004/0095404 | A1* | 5/2004 | Iwao et al. | 347/10 |
| 2004/0114004 | A1* | 6/2004 | Taira | 347/87 |
| 2005/0073562 | A1 | 4/2005 | Taira | |
| 2005/0083379 | A1* | 4/2005 | Chikamoto | 347/68 |

FOREIGN PATENT DOCUMENTS

| | | | |
|---|---|---|---|
| JP | 57167272 | A * | 10/1982 |
| JP | H07-101051 | A | 4/1995 |
| JP | H09-164671 | A | 6/1997 |
| JP | 1134324 | | 2/1999 |
| JP | 2003-311958 | A | 11/2003 |
| JP | 2004114423 | | 4/2004 |

OTHER PUBLICATIONS

Wikipedia article-Epoxy.*

Japan Patent Office; Notification of Reasons for Refusal in Japanese Patent Application No. 2005-007628 (counterpart to the above-captioned U.S. patent application) mailed Mar. 2, 2010.

* cited by examiner

*Primary Examiner*—Matthew Luu
*Assistant Examiner*—Lisa M Solomon
(74) *Attorney, Agent, or Firm*—Baker Botts, LLP.

(57) ABSTRACT

An inkjet head includes a flow-path unit, a reservoir unit and an actuator unit. The flow-path unit includes a common ink chamber and plural individual ink flow paths. The actuator unit includes plural first electrodes and a second electrode. The first electrodes are arranged to correspond to pressure chambers, respectively. The first electrodes are fed selectively with respective drive voltages for varying a volume of the pressure chambers. One of the flow-path unit and the reservoir unit includes a first metal portion, and the other includes a second metal portion. The metal portion of the flow-path unit and the second electrode are electrically connected with each other. The first metal portion and the second metal portion are jointed to each other through an insulating material layer. An electric connection portion, which is in direct contact with the second metal portion, is integrated with the first metal portion.

8 Claims, 18 Drawing Sheets

INKJET HEAD

This application is based upon and claims the benefit of priority from Japanese Patent Application No. 2005-7628 filed on Jan. 14, 2005; the entire contents of which are incorporated herein by reference.

BACKGROUND OF THE INVENTION

1. Field of the Invention

The invention relates to an inkjet head for ejecting ink to a recording medium.

2. Description of the Related Art

U.S. 2005/0073562 discloses an inkjet head for ejecting ink from nozzles to a recording medium such as recording paper. This inkjet head includes: a flow-path unit formed with an ink flow path including the nozzles; a reservoir unit for reserving the ink to be fed to the flow-path unit; and an actuator units for applying an ejection energy to the ink in the flow-path unit. The flow-path unit and the reservoir unit have structures in each of which a plurality of metal plates are stacked. The reservoir unit is so jointed to the flow-path unit that its internal flow path communicates with the ink flow path of the flow-path unit. Moreover, the actuator unit is fed with a drive signal from a drive circuit through a flexible flat cable to feed the ink in the flow-path unit with ejection energy.

In the foregoing examples, all of the related art and limitations related thereto are intended to be illustrative and not exclusive. Other limitations of the related art will become apparent to those skilled in the art on a reading of the specification and a study of the drawings.

SUMMARY OF THE INVENTION

Here, if the inkjet head is not wholly kept at a predetermined potential, charges stored at a portion other than an electrode portion of an actuator unit may be released to the electrode portion thereby to break circuit elements of a drive circuit. It is, therefore, preferable that the inkjet head is wholly kept at the predetermined reference potential (e.g., the ground potential). If the electrode portion of the actuator units is electrically connected through the metallic flow-path unit to the metallic reservoir unit kept at the reference potential with the flow-path unit, the reservoir unit and the actuator units being assembled, the inkjet head can be kept simply and reliably at the reference potential. As a matter of fact, however, a filter for filtering out dust from ink fed from the reservoir unit to the flow-path unit is generally interposed between the flow-path unit and the reservoir unit. Moreover, a synthetic resin material, which can be easily holed by a laser working, may be used as the material for the filter. In this case, the reservoir unit and the flow-path unit are insulated by the filter made of the insulating material so that the electrode portion of the actuator unit cannot be electrically connected with the reservoir unit through the flow-path unit.

The following embodiments and aspects thereof are described and illustrated in conjunction with systems, tools and methods that are meant to be exemplary and illustrative, and not limiting in scope. In various embodiments, one or more of the above-described problems have been reduced or eliminated, while other embodiments are directed to other improvements.

The invention provides an inkjet head capable of electrically connecting an electrode portion of an actuator unit easily and reliably to a metal portion of a reservoir unit through a flow-path unit.

According to one aspect of the invention, an inkjet head includes a flow-path unit, a reservoir unit and an actuator unit. The flow-path unit includes a common ink chamber, and a plurality of individual ink flow paths each of which extends from the common ink chamber to a nozzle through a pressure chamber. The reservoir unit reserves ink to be fed to the common ink chamber. The actuator unit varies a volume of the pressure chambers. The actuator unit includes a plurality of first electrodes and a second electrode. The first electrodes are arranged to correspond to the plurality of pressure chambers, respectively. The first electrodes are fed selectively with respective drive voltages for varying the volume of the pressure chambers. The second electrode is kept at a reference potential. One of the flow-path unit and the reservoir unit includes a first metal portion. The other of the flow-path unit and the reservoir unit includes a second metal portion. The metal portion of the flow-path unit and the second electrode of the actuator unit are electrically connected with each other. The first metal portion and the second metal portion are jointed to each other through an insulating material layer. An electric connection portion, which is in direct contact with the second metal portion, is integrated with the first metal portion.

In this inkjet head, when the drive voltage is applied from a drive circuit to the first electrodes of the actuator unit, the volume of the pressure chambers corresponding to the first electrodes varies to apply pressure to the ink in the pressure chambers, to thereby eject the ink from the nozzles communicating with the pressure chambers. Here, the second electrode of the actuator unit and the metal portion of the flow-path unit are electrically connected with each other, and the metal portion of the flow-path unit and the metal portion of the reservoir unit are electrically connected with each other through the electric connection portion. Therefore, the second electrode of the actuator unit can be electrically connected with the metal portion of the reservoir unit through the metal portion of the flow-path unit to thereby keep the inkjet head substantially entirely at an equal potential, even in case where the insulating material layer is interposed between the metal portion of the flow-path unit and the metal portion of the reservoir unit as in the case where the filter made of the insulating material is interposed between the flow-path unit and the reservoir unit and/or in the case where at least one of the flow-path unit and the reservoir unit is partially made of the insulating material. Therefore, the inkjet head can also be entirely kept at the reference potential so long as any portion is kept at the reference potential. Moreover, the electric connection portion is integrated with the first metal portion. Therefore, the structure of the electric connection portion is simplified while allowing eliminating another conductive member for electrically connecting the reservoir unit and the flow-path unit with each other, so that the cost for manufacturing the inkjet head can be lowered.

According to another aspect of the invention, an inkjet head includes a flow-path unit, a reservoir unit and an actuator unit. The flow-path unit includes a common ink chamber, and a plurality of individual ink flow paths each of which extends from the common ink chamber to a nozzle through a pressure chamber. The reservoir unit reserves ink to be fed to the common ink chamber. The actuator unit varies a volume of the pressure chambers. The actuator unit includes a plurality of piezoelectric sheets, a plurality of first electrodes and a second electrode. The piezoelectric sheets are arranged on one surface of the flow-path unit and are stacked on each other. The first electrodes are arranged opposite the plurality of pressure chambers. Drive voltages are selectively applied to the first electrodes, respectively. The second electrode is arranged between at least two of the plurality of piezoelectric sheets. One of the flow-path unit and the reservoir unit includes a first metal portion. The other of the flow-path unit and the reservoir unit includes a second metal portion. The metal portion of the flow-path unit and the second electrode of the actuator unit are connected with each other through a conductive material. The first metal portion and the second metal portion are jointed to each other through an insulating material layer. The first metal portion and the second metal portion are connected with each other through a conductive member fixed to the first metal portion and the second metal portion.

The second electrode of the actuator unit and the metal portion of the flow-path unit are electrically connected with each other, and the metal portion of the flow-path unit and the metal portion of the reservoir unit are electrically connected with each other through the conductive member. Therefore, in the case where the an insulating material layer is interposed between the metal portion of the flow-path unit and the metal portion of the reservoir unit, the second electrode of the actuator unit can be electrically connected with the metal portion of the reservoir unit through the metal portion of the flow-path unit, so that the second electrode can be reliably kept at the reference potential. In other words, the inkjet head can be kept in its substantial entirety at the reference potential.

In addition to the exemplary aspects and embodiments described above, further aspects and embodiments will become apparent by reference to the drawings and by study of the following descriptions.

DETAILED DESCRIPTION OF EMBODIMENTS OF THE INVENTION

Figure 1:
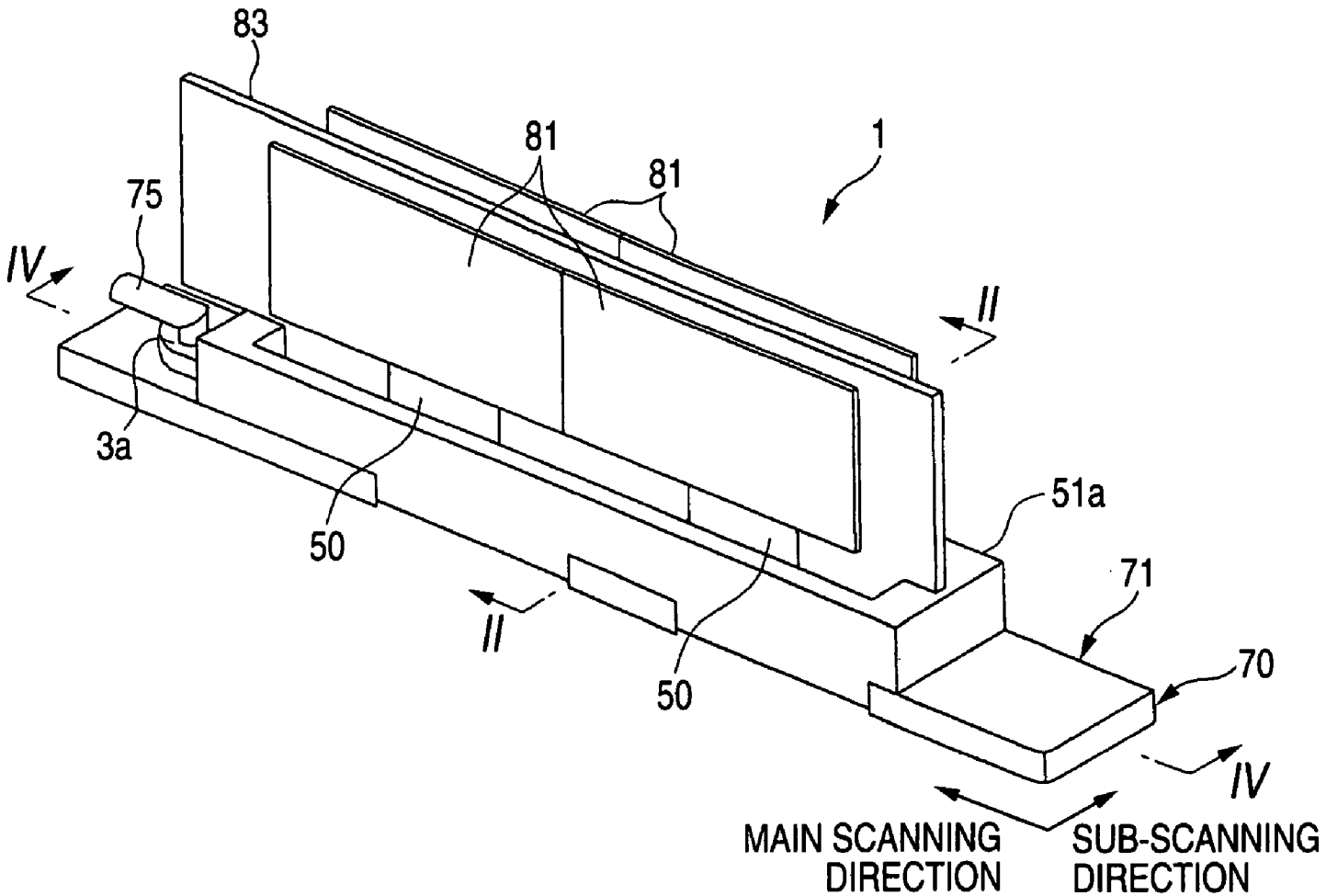
FIG. 1 is a perspective view of an inkjet head 1 according to an embodiment of the invention.
Figure 2:
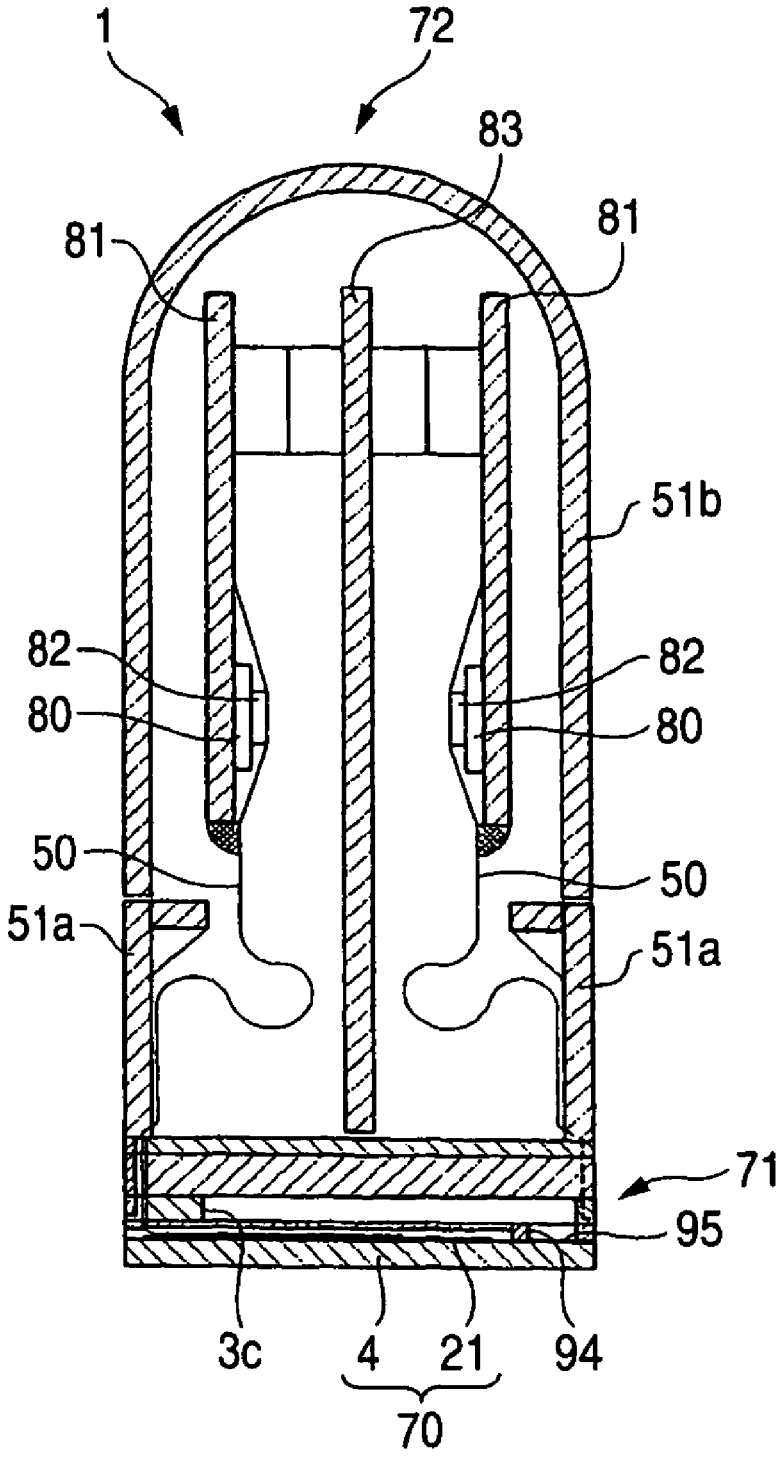
FIG. 2 is a section taken along line II-II of FIG. 1.

One embodiment of the invention will be described with reference to FIG. 1 to FIG. 12. FIG. 1 is a perspective view of an inkjet head, and FIG. 2 is a section taken along line II-II of FIG. 1. The inkjet head of this embodiment is disposed in an (not-shown) ink jet printer and ejects ink to paper being conveyed so that an image is formed on the paper. As shown in FIG. 1 and FIG. 2, the inkjet head 1 has a head body 70, a reservoir unit 71, a lower cover 51*a* and an upper cover 51*b*. The head body 70 has a rectangular shape in plan view, which elongates in one direction (main scanning direction). The head body 70 ejects ink to the paper. The reservoir unit 71 is arranged on the upper surface of the head body 70 and has an ink reservoir 3*c* formed therein. The lower cover 51*a* and the upper cover 51*b* protect the inside of the inkjet head 1 against ink droplets. For the sake of conveniences of explanation, the upper cover 51*b* is omitted from FIG. 1.

The head body 70 includes a flow-path unit 4 having an ink flow path formed therein, and an actuator unit 21 arranged on the upper surface of the flow-path unit 4. The flow-path unit 4 and the actuator unit 21 are constructed of laminate bodies each including a plurality of thin sheets.

A protrusion portion is formed in the lower surface of the reservoir unit 71 to protrude downward. In this protrusion portion, ink outlet ports 94 are formed. At opening portions of the ink outlet ports 94, the reservoir unit 71 and the flow-path unit 4 are connected with each other. A filter 95 is interposed between the reservoir unit 71 and the flow-path unit 4 to cover the opening portions of the ink outlet ports 94. The filter 95 is formed by forming a large number of holes in a substrate made of a synthetic resin material such as polyimide and having. Moreover, that area of the reservoir unit 71, which is other than the near portion of the ink outlet ports 94 in a plan view, is spaced upward from the head body 70. The actuator unit 21 is arranged in this gap. Flexible printed circuits (FPC) 50 are electrically connected with the upper surfaces of the actuator units 21. The FPCs 50 are drawn to the outside of the actuator unit 21 from both sides of the actuator units 21 in the sub-scanning direction. In other words, the lower surface of the reservoir unit 71 protrudes in the vicinity of the opening portions to contact with the flow-path unit 4. In the area other than the protrusion portion, the actuator unit 21 and the FPCs 50 are arranged in the gap portion between the reservoir unit 71 and the flow-path unit 4 with leaving a predetermined space.

The reservoir unit 71 has substantially the same rectangular shape in plan view as that of the flow-path unit 4. The ink to be fed to the flow-path unit 4 is reversed in the inside ink reservoir 3*c*. An ink feed pipe 75, which leads to an (not-shown) ink cartridge, is connected with an ink feed port 3*a* formed in one end portion (as located on the left end portion of FIG. 1) of the reservoir unit 71 in the main scanning direction. In short, the ink reservoir 3*c* is fed with the ink through the ink feed pipe 75.

A main substrate 83 is erected on the upper surface of the reservoir unit 71. Two sub-substrates 81 are arranged in parallel to the main substrate 83 on both sides of the main substrate 83. These two sub-substrates 81 and the main substrate 83 are electrically connected with each other. Also, respective driver ICs 80 are arranged on the surfaces of the two sub-substrates 81, which face the main substrate 83. A heat sink 82 is attached in close contact to each driver IC 80 so as to efficiently radiate heat to be generated in the inside of the driver IC 80. Moreover, the sub-substrates 81 and the driver ICs 80 are electrically connected with the FPCs 50, which are respectively drawn from the two right and left sides of the actuator unit 21, as shown in FIG. 2. Moreover, signals output from the sub-substrates 81 are transmitted to the driver ICs 80, and drive signals output from the driver ICs 80 are transmitted to the actuator units 21 of the head body 70 through the FPCs 50.

As shown in FIG. 2, the lower cover 51*a* is a block-shaped casing opened upward, and is so arranged over the head body 70 as to cover the FPCs 50 drawn upward of the reservoir unit 71, from the outer side. Moreover, the FPCs 50 are housed in the lower cover 51*a* in a loose state to apply no stress thereto.

The upper cover 51*b* is a casing having an arched ceiling, and is arranged on the upper side of the lower cover 51*a*. In other words, the main substrate 83 and the sub-substrates 81 are housed in the upper cover 51*b* and the lower cover 51*a*. According to this structure, it is prevented that a foreign substance such as ink is attached to the main substrate 83 and the sub-substrates 81 from the outside and that the main substrate 83 and the sub-substrates 81 are in unnecessarily electric contact with other portions and short-circuited with the other portions.

Figure 3:
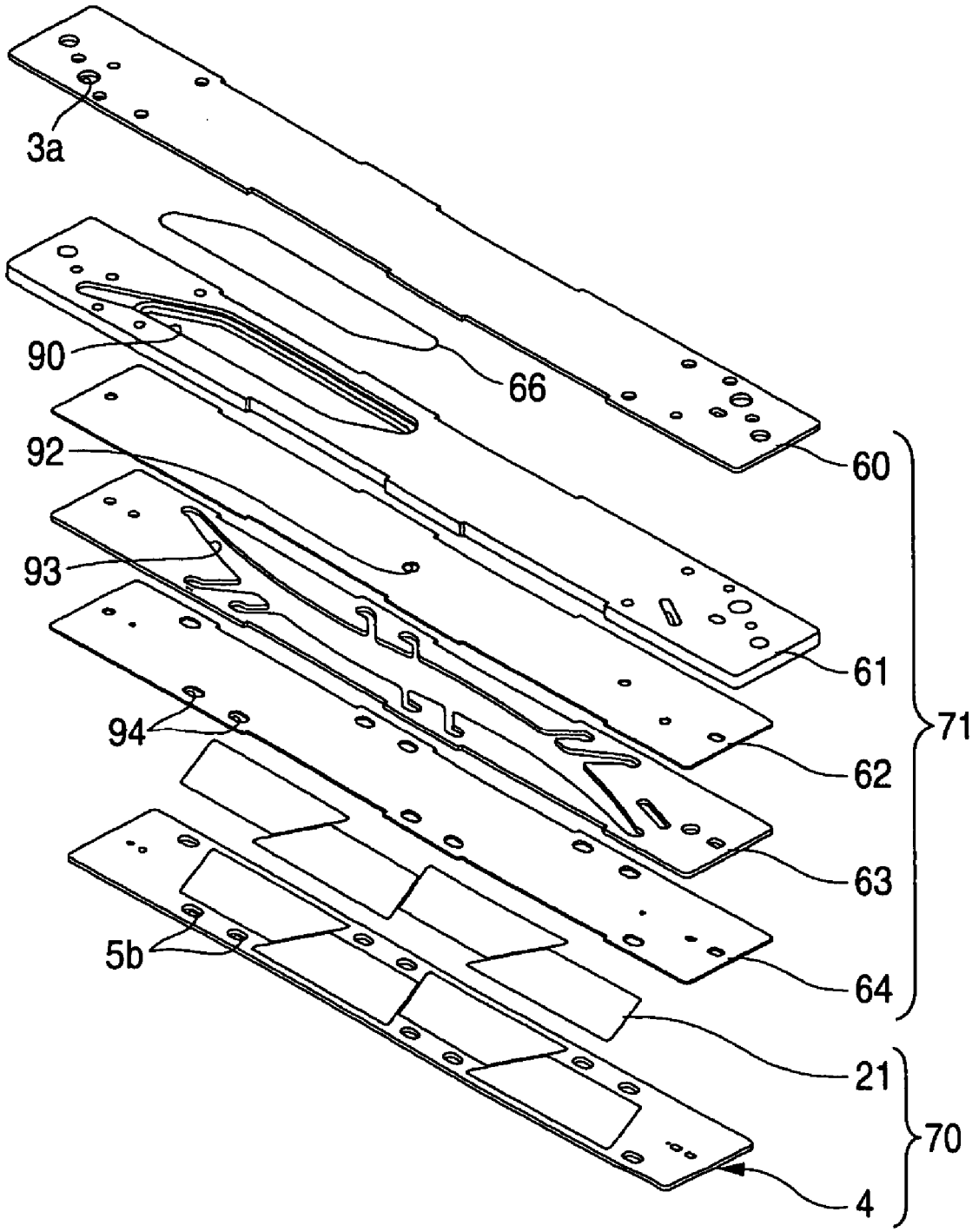
FIG. 3 is an exploded perspective view showing a stacking state of plates forming a reservoir unit 71 and a head body 70.
Figure 4:
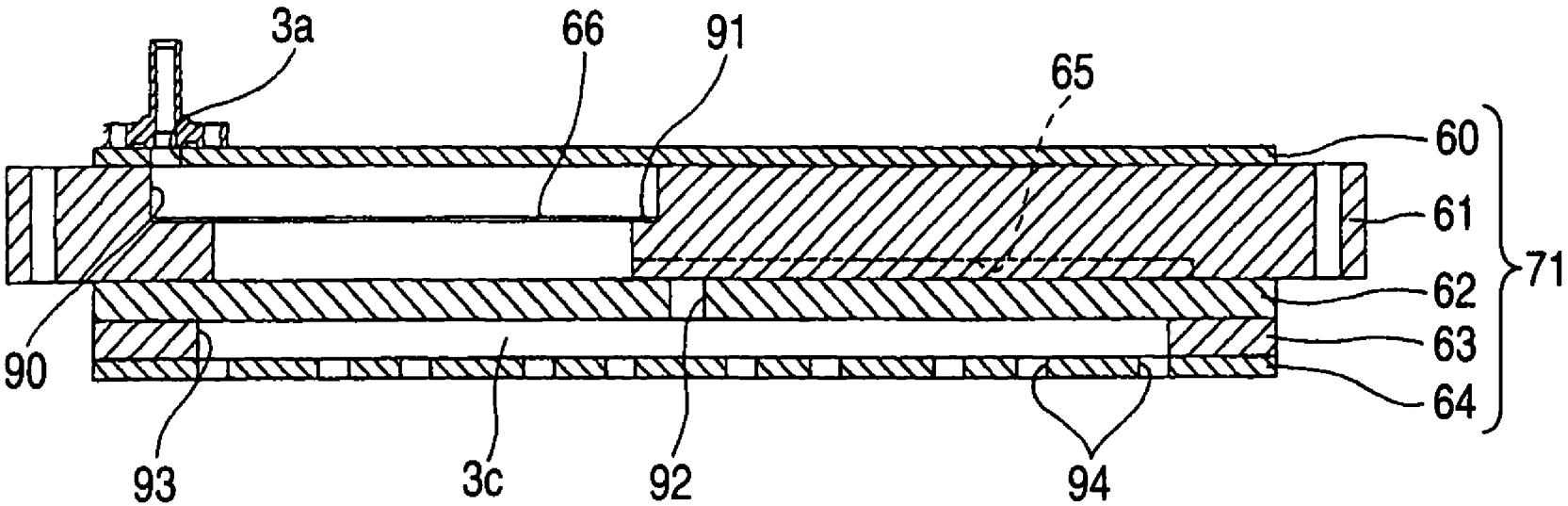
FIG. 4 is a section of the reservoir unit 71 of FIG. 1 taken along line IV-IV.

Next, the structure of the reservoir unit 71 will be described with reference to FIG. 3 and FIG. 4. FIG. 3 is an exploded perspective view showing the stacking state of plates forming the reservoir unit 71 and the head body 70. FIG. 4 is a section of the reservoir unit 71 of FIG. 1 as taken along line IV-IV. As shown in FIG. 3 and FIG. 4, the reservoir unit 71 has a structure in which a first reservoir plate 60, a second reservoir plate 61, a third reservoir plate 62, a fourth reservoir plate 63 and a fifth reservoir plate 64 are stacked sequentially downward in this order. The reservoir unit 71 is arranged on the upper side of the head body 70 (including the actuator unit 21 and the flow-path unit 4). The five reservoir plates 60 to 64 are metal plates of a substantially rectangular shape elongating in the main scanning direction. As shown in FIG. 4, the ink reservoir 3*c* that reserves the ink temporarily is formed by sealing a reservoir hole 93 formed in the fourth reservoir plate 63 with the third reservoir plate 62 and the fifth reservoir plate 64 from the upper and lower sides.

The ink feed port 3*a* to which the ink feed pipe 75 (see FIG. 2) is to be connected is formed at one end portion of the first reservoir plate 60 in the main scanning direction.

A filter mounting hole 90 for mounting a filter 66 is formed in the second reservoir plate 61. This filter mounting hole 90 communicates with the ink feed port 3*a*. A stepped filter support 91 is formed in an intermediate portion of the filter mounting hole 90 in its thickness direction to be along the inner periphery of the filter mounting hole 90. The filter support 91 supports the filter 66. The filter 66 filters the ink fed from the ink feed port 3*a*, thereby to prevent dust or the like from entering into the ink flow path including nozzles 8 and pressure chambers 10 (see FIG. 6 and FIG. 7) of the flow-path unit 4.

An ink drop-in flow path 65, which extends horizontally from the filter mounting hole 90, is formed on the lower surface side of the second reservoir plate 61. The ink drop-in flow path 65 merges into an ink drop-in port 92, which is formed substantially at the central portion of the third reservoir plate 62 in plan view.

The fourth reservoir plate 63 is provided with the reservoir hole 93, which elongates in the main scanning direction (in the right and left direction of FIG. 3 and FIG. 4). This reservoir hole 93 extends with branching to positions, which overlap the openings 5*b* of manifolds 5 of the flow-path unit 4 (see FIG. 3), which will be described later, in plan view.

The fifth reservoir plate 64 is provided with the plurality of ink outlet ports 94 for feeding out the ink in the ink reservoir 3*c* into the flow-path unit 4 (i.e., the openings 5*b*). These ink outlet ports 94 are formed to overlap the openings 5*b* of the manifold 5 in plan view.

Moreover, the ink having flown from the ink feed pipe 75 via the ink feed port 3*a* into the reservoir unit 71 is fed from the ink outlet ports 94 into the manifold 5 of the flow-path unit 4 via the inside of the filter mounting hole 90, the ink drop-in flow path 65 and the ink reservoir 3*c*.

Figure 5:
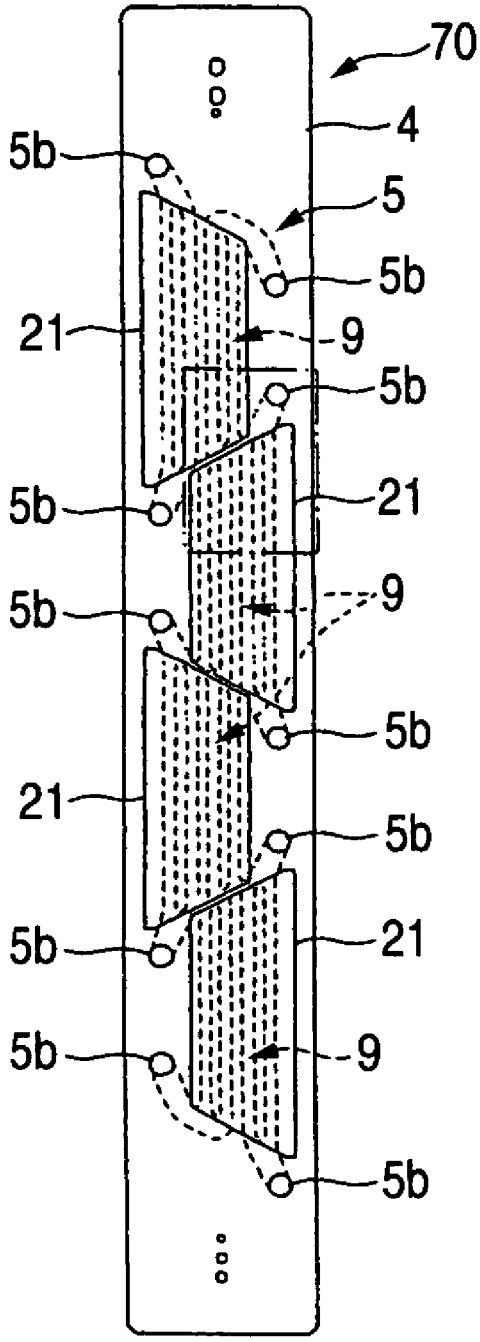
FIG. 5 is a plan view of the head body 70.
Figure 6:
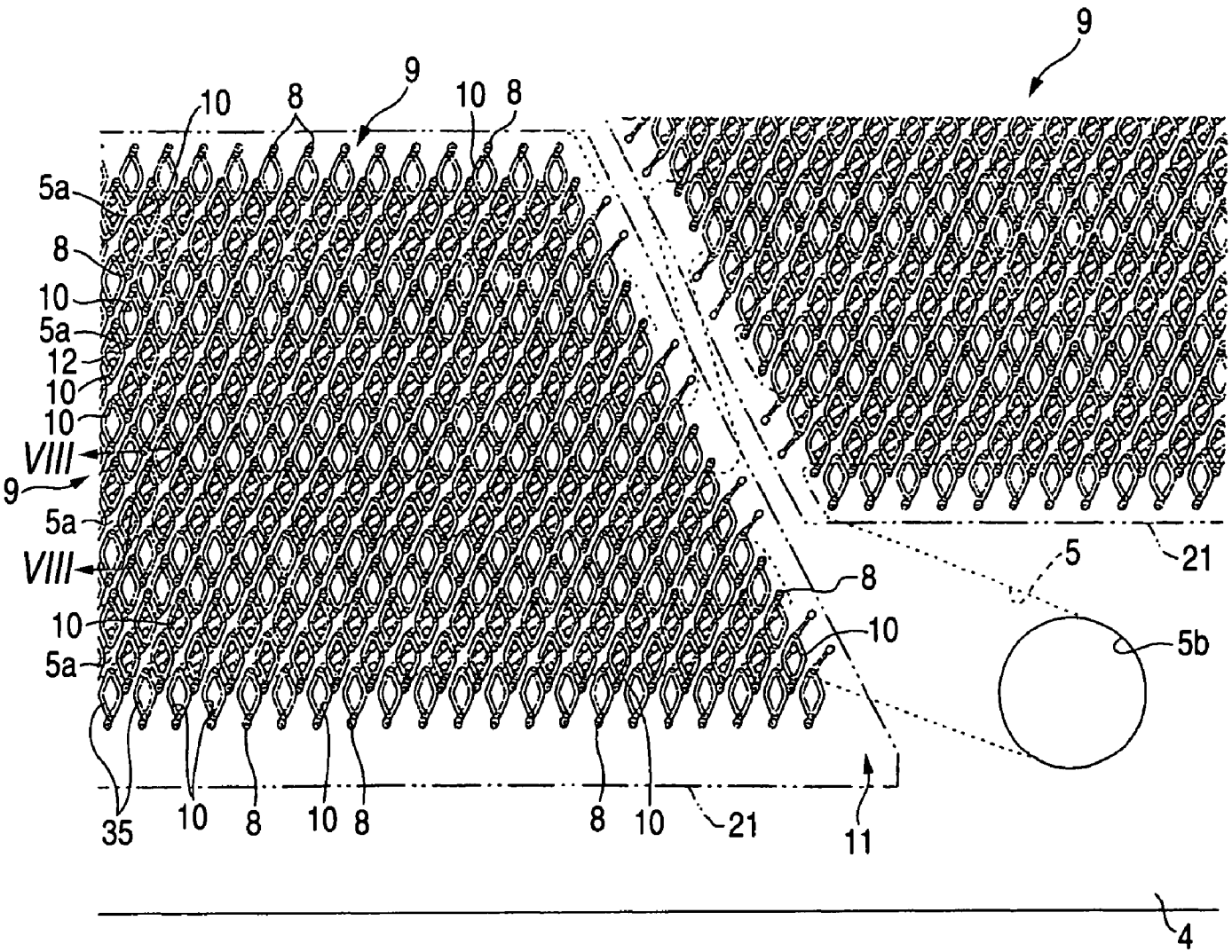
FIG. 6 is an enlarged view of a region enclosed by single-dotted lines in FIG. 5.

Next, the head body 70 will be described below. FIG. 5 is a plan view of the head body 70. FIG. 6 is an enlarged view of a region enclosed by single-dotted lines in FIG. 5. As shown in FIG. 5 and FIG. 6, the head body 70 includes the flow-path unit 4 and the four actuator units 21 having a trapezoidal shape in plan view. The flow-path unit 4 has the large number of pressure chambers 10 and the large number of nozzles 8. The actuator units 21 are arranged in two rows in a staggered manner on the upper surface of the flow-path unit 4.

The plurality of manifolds 5 are formed in the flow-path unit 4. The manifolds 5 communicate with the ink outlet ports 94 (see FIG. 3 and FIG. 4) of the reservoir unit 71 at their openings 5*b*. Each manifold 5 branches at its leading end, from which sub-manifolds 5*a* extend in the longitudinal direction of the flow-path unit 4. The four actuator units 21 are so arranged that their opposite parallel sides (e.g., the upper side and the lower side) extend along the longitudinal direction of the flow-path unit 4. Moreover, the oblique lines of the adjacent actuator units 21 overlap each other in the widthwise direction of the flow-path unit 4.

The surface (i.e., the lower surface) of the flow-path unit 4 on the opposite side of the actuator units 21 is formed into an ink ejection region in which the large number of nozzles 8 are arranged in a matrix manner. The pressure chambers 10 each of which communicates with one nozzle 8 are also arranged in a matrix manner on the upper surface of the flow-path unit 4. A plurality of pressure chambers 10 are gathered to form a pressure chamber group 9. In this embodiment, the four pressure chamber groups 9 are formed and one actuator unit 21 faces each of the pressure chamber groups 9.

Moreover, each nozzle 8 is tapered so as to have the smaller diameter as coming closer to its leading end. The nozzles 8 communicate with the sub-manifolds 5*a* through the pressure chambers 10 each having a rhombic shape in plan view and apertures 12. Here, in FIG. 6, the pressure chambers 10 (the pressure chamber groups 9), the openings 5*b* and the apertures 12 are drawn with the solid lines, although they should be drawn with broken lines because they are located below the actuator units 21. Also, the actuator units 21 to be drawn with solid lines are indicated by double-dotted lines.

Figure 7:
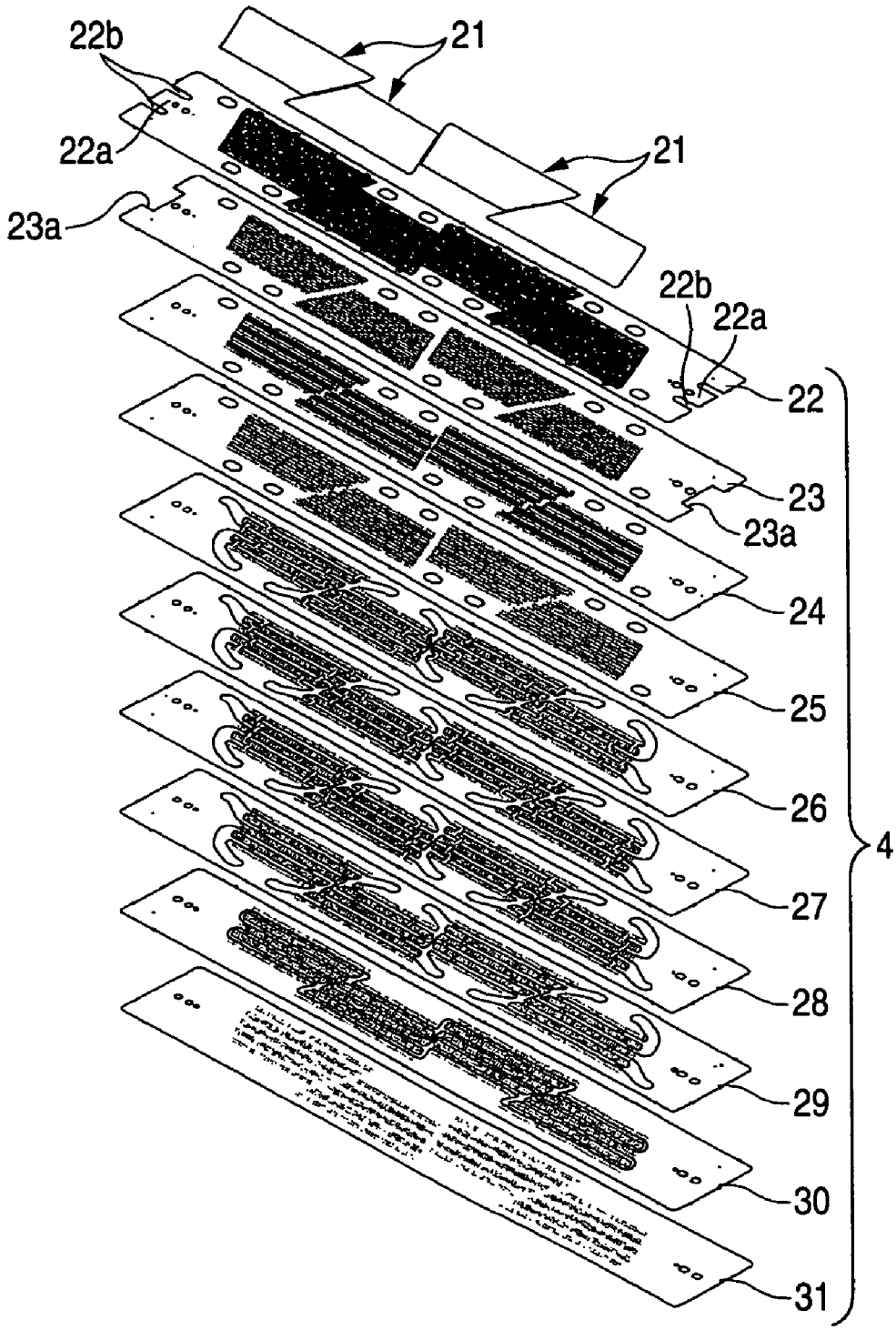
FIG. 7 is an exploded perspective view showing a stacking state of plates for forming a flow-path unit 4 and the actuator unit 21.
Figure 8:
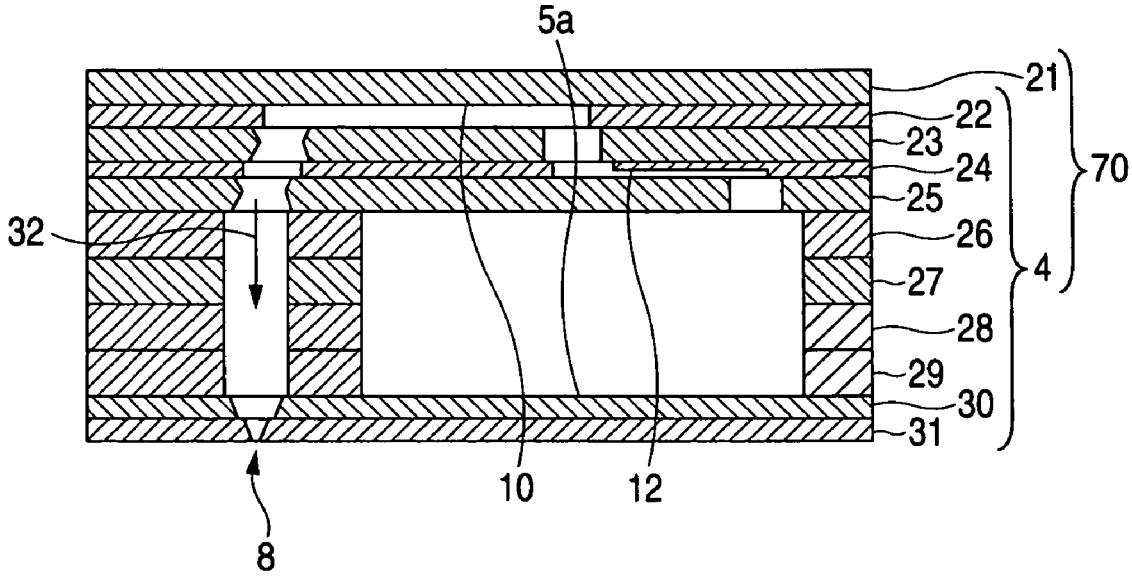
FIG. 8 is a section taken along line VIII-VIII of FIG. 6.

Next, the structure of the head body 70 will be described with reference to FIG. 7 and FIG. 8. FIG. 7 is an exploded perspective view showing the stacking state of plates 22 to 31 forming the flow-path unit 4 and the actuator unit 21. FIG. 8 is a section taken along line VIII-VIII of FIG. 6.

As shown in FIG. 7, the head body 70 includes the actuator units 21 and the flow-path unit 4. Of these, the actuator unit 21 has four piezoelectric sheets 41 to 44 (see FIG. 9A) stacked on each other. These piezoelectric sheets 41 to 44 are individually made of a ceramic material of lead zirconate titanate (PZT) having ferromagnetic properties. Here, the uppermost piezoelectric sheet 41 has a portion, which becomes an active layer when an electric field is applied, but the remaining three piezoelectric sheets 42 to 44 are inactive layers, as described later. On the other hand, the flow-path unit 4 has a structure in which ten plates of a cavity plate 22, a base plate 23, an aperture plate 24, a supply plate 25, manifold plates 26, 27, 28 and 29, a cover plate 30 and a nozzle plate 31 are stacked. These ten plates are individually metal plates made of stainless steel or the like.

The cavity plate 22 is provided with the plurality of pressure chambers 10 in the matrix manner. The base plate 23 is provided with communication holes for communicating the pressure chambers 10 with the apertures 12, and communication holes for communicating the pressure chambers 10 to the nozzles 8. The aperture plate 24 is provided with the apertures 12 formed by means of half-etching, and communication holes for communicating the pressure chambers 10 to the nozzles 8. Also, the supply plate 25 is provided with communication holes for communicating the apertures 12 with the sub-manifolds 5*a*, and communication holes for communicating the pressure chambers 10 to the nozzles 8. Moreover, the four manifold plates 26 to 29 are provided with the manifolds 5 (see FIG. 5 and FIG. 6), the sub-manifolds 5*a* branched from the manifolds 5, and communication holes for communicating the pressure chambers 10 to the nozzles 8. The cover plate 30 is provided with communication holes for communicating the pressure chambers 10 to the nozzles 8. Moreover, the nozzle plate 31 is provided with the plural nozzles 8 arranged in the matrix manner.

As shown in FIG. 8, moreover, those ten metal plates 22 to 31 are stacked with positioned to each other to provide every pressure chamber 10 with an individual ink flow path 32 extending from the sub-manifold 5*a* through the aperture 12 and the pressure chamber 10 to the nozzle 8.

Figure 9A:
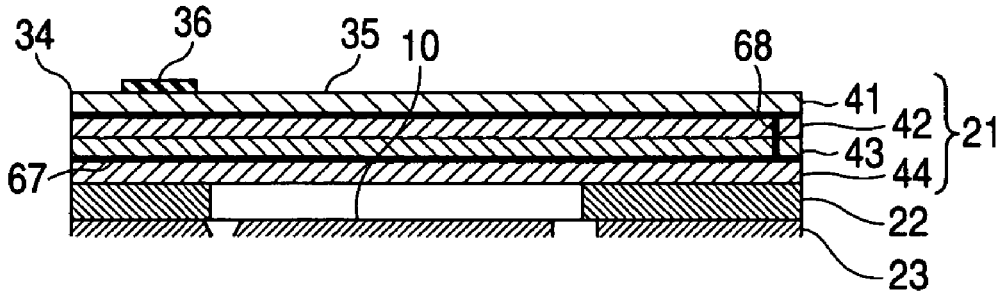
FIG. 9A is an enlarged section of a portion of the actuator unit 21.

Here is described the structure of the actuator unit 21, which is stacked on the cavity plate 22 of the uppermost layer in the flow-path unit 4. FIG. 9A is an enlarged section of a portion of the actuator unit 21, and FIG. 9B is a plan view of an individual electrode.

As shown in FIG. 9A, the actuator unit 21 includes the four piezoelectric sheets 41 to 44, a plurality of individual electrodes 35 (functioning as first electrodes) and a common electrode 34 (functioning as a second electrode). The four piezoelectric sheets 41 to 44 extend across the plurality of pressure chambers 10. The individual electrodes 35 are arranged on the upper most piezoelectric sheet 41 and opposite the plural pressure chambers 10, respectively. The common electrode 34 and the individual electrodes 35 sandwich the uppermost piezoelectric sheet 41 therebetween.

The piezoelectric sheets 41 to 44 have substantially equal thicknesses (e.g., about 15 μm) and are adhered to the upper surface of the cavity plate 22. Therefore, the individual electrodes 35 can be formed in a high density over the piezoelectric sheet 41 by using the screen printing technique or the like.

Figure 9B:
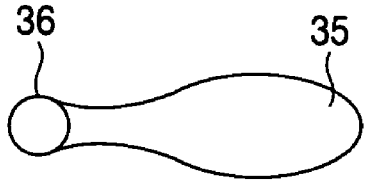
FIG. 9B is a plan view of an individual electrode 35 and a land portion 36.

As shown in FIG. 9B, each individual electrode 35 has a rhombic shape in plan view substantially similar to but smaller than that of the pressure chambers 10. As shown in FIG. 6, the individual electrodes 35 are formed in such regions as to be housed in the pressure chambers 10 in plan view, and are arranged like the pressure chambers 10 in the matrix manner. One ends of the acute portions in the substantially rhombic-shaped individual electrodes 35 extend in the same direction, and these extended portions are provided with land portions 36. These land portions 36 are formed in a circular shape having a diameter of about 160 μm, and are made of gold containing glass frit, for example. Moreover, the land portions 36 are electrically jointed to contacts, which are formed on the FPCs 50 (see FIG. 1 and FIG. 2), so that drive signals for varying the volumes of the pressure chambers 10 are input from the driver ICs 80 (see FIG. 1 and FIG. 2) through the land portions 36 to the individual electrodes 35.

The common electrode 34 is formed between the uppermost piezoelectric sheet 41 and the underlying piezoelectric sheet 42 so as to cover the entire sheet across the plural pressure chambers 10. Here, the common electrode 34 has a thickness of about 2 μm, for example. A reinforcing electrode 67 (functioning as a third electrode) that reinforces the piezoelectric sheets 41 to 44 is formed between the lower two piezoelectric sheets 43 and 44 so as to cover the entire sheet across the plural pressure chambers 10. Moreover, the common electrode 34 and the reinforcing electrode 67 are electrically connected with each other through a conductive material 68 filling through holes of the piezoelectric sheets 43 and 44. The common electrode 34 and the reinforcing electrode 67 are equally kept at the ground potential (functioning as a reference potential) in the region opposite to all the pressure chambers 10, as will be described later.

Here, all the individual electrodes 35, the common electrode 34 and the reinforcing electrode 67 are made of a metallic material such as an Ag—Pd group.

Here will be described an operation of the actuator units 21 when ejecting the ink. A polarization direction of the piezoelectric sheet 41 in each actuator unit 21 is its thickness direction. Specifically, each actuator unit 21 has a structure of the so-called "unimorph type" in which the upper (i.e., being apart from the pressure chambers 10) single piezoelectric sheet 41 contains an active layer whereas the lower (i.e., being close to the pressure chambers 10) three piezoelectric sheets 42 to 44 are made inactive. When the individual electrodes 35 are set at a predetermined positive or negative potential, if electric field and the polarization have the same direction, an electric-field applied portion of the piezoelectric sheet 41 sandwiched between the electrodes act as the active layer to shrink in a direction perpendicular to the polarization direction due to the longitudinal piezoelectric effect. On the other hand, the piezoelectric sheets 42 to 44 are not subject to the influence of the electric field, so that they do not shrink voluntarily. As a result, a difference in a distortion in the direction perpendicular to the polarization direction is caused between the upper piezoelectric sheet 41 and the lower piezoelectric sheets 42 to 44, so that the entirety of the piezoelectric sheets 41 to 44 are deformed to be convex toward the inactive side (the unimorph deformation). At this time, as shown in FIG. 9A, the lower surface of the piezoelectric sheets 41 to 44 is fixed onto the upper surface of the cavity plate 22 defining the pressure chambers 10, so that the piezoelectric sheets 41 to 44 are deformed to be convex toward the pressure chambers 10. Then, the volume of the pressure chambers 10 is reduced to raise the pressure of the ink and then, the ink is ejected from the nozzles 8. Thereafter, when the individual electrodes 35 are returned to the same potential as that of the common electrode 34, the piezoelectric sheets 41 to 44 are restored to their original shapes and the pressure chambers 10 are restored their original volumes. As a result, the ink is sucked from the manifolds 5.

Here, another driving method may also be adopted. The individual electrodes 35 may be preset at a potential different from the common electrode 34, the individual electrodes 35 may be once set at the same potential as that of the common electrode 34 in response to each demand for the ejection, and then the individual electrodes 35 may be again set at a potential different from that of the common electrode 34 at a predetermined timing. In this case, at the timing where the individual electrodes 35 and the common electrode 34 take the same potential, the piezoelectric sheets 41 to 44 are restored to their original shapes, so that the volume of the pressure chambers 10 increases from that in the initial state (in which the both electrodes have different potentials). As a result, the ink is sucked from the sub-manifolds 5*a* into the pressure chambers 10. Thereafter, the individual electrodes 35 may be set to a potential different from that of the common electrode 34. At this timing, the piezoelectric sheets 41 to 44 are deformed to be convex toward the pressure chambers 10, so that the volume of the pressure chambers 10 is reduced to raise the pressure of the ink to thereby eject the ink from the nozzles 8.

Here, the common electrode 34 has to be reliably kept at a predetermined reference potential (e.g., the ground potential). Unless the common electrode 34 is kept at the ground potential, electric charges are stored in the common electrode 34 and potential of the common electrode 34 fluctuates. As a result, when the drive voltage is applied from the driver ICs 80 to the individual electrodes 35, a sufficient potential difference cannot be generated between the individual electrodes 35 and the common electrode 34. In the worst case, it becomes impossible to eject the ink at a desired speed from the nozzles 8. If the electric charges are stored in the common electrode 34, on the other hand, the charges may be discharged to break circuit elements of the driver ICs 80. If, moreover, the common electrode 34 and the reinforcing electrode 67 electrically connected with the common electrode 34 are charged to minus potential, water contained in the ink is electrolyzed due to potential difference between the charged electrode and the ink. Hydrogen ions ($H^+$) produced by the electrolysis of the water contained in the ink are absorbed in the reinforcing electrode 67 (especially in its Pd). As a result, the reinforcing electrode 67 may swell to peel off the piezoelectric sheets 43 and 44, which clamping the reinforcing electrode 67 therebetween from the two upper and lower sides, to thereby break the actuator units 21.

Figure 10:
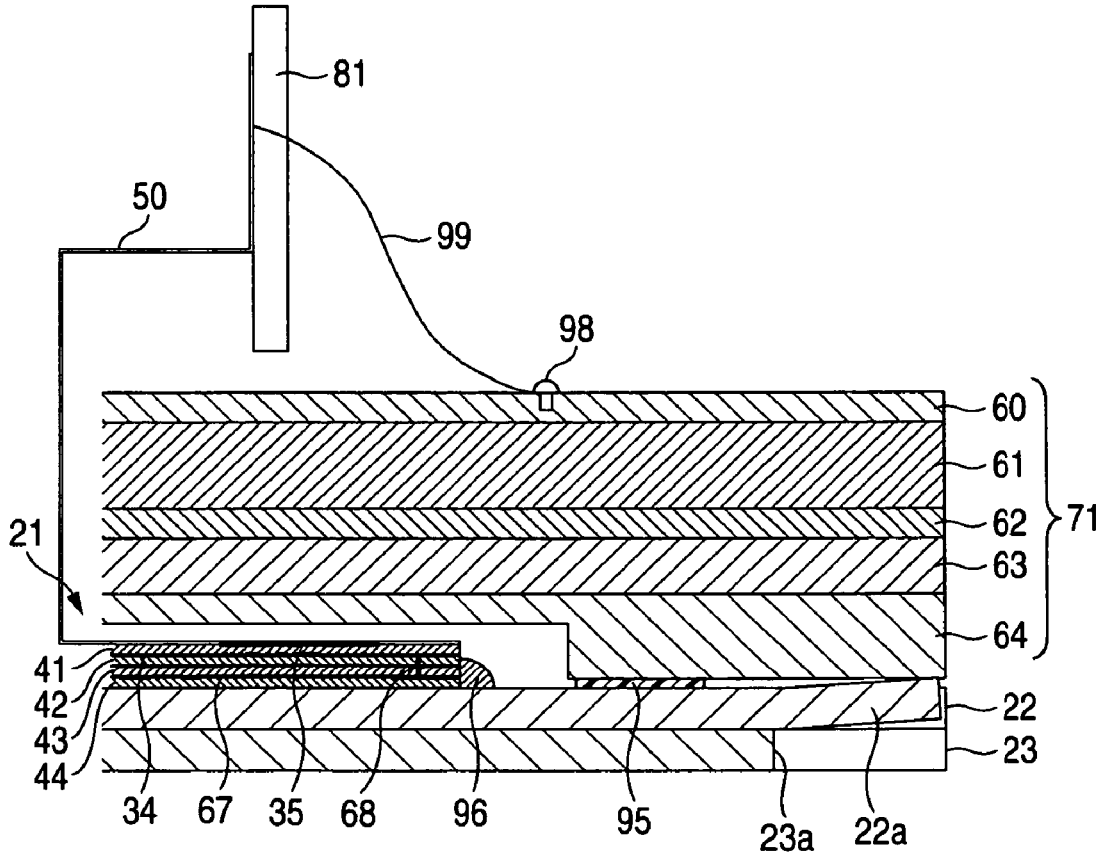
FIG. 10 is an enlarged section of a main portion of the head body 70 and the reservoir unit 71.

In the inkjet head 1 of this embodiment, therefore, the common electrode 34 and the reinforcing electrode 67 are kept at the ground potential by the following structure. FIG. 10 is an enlarged section of a main portion of the head body 70 and the reservoir unit 71. As shown in FIG. 10, the reinforcing electrode 67 electrically connected with the common electrode 34 is exposed to the outside through gap between the piezoelectric sheets 43 and 43. Furthermore, the reinforcing electrode 67 is electrically connected with the metallic cavity plate 22 through a paste conductive material 96 formed from the piezoelectric sheets 42 to 44 to the upper surface of the metallic cavity plate 22. On the other hand, the reservoir unit 71, which is located on the upper side of the cavity plate 22 and includes the five laminated meal plates 60 to 64, is connected with the sub-substrates 81 through a metallic wire 99 fixed onto the uppermost first reservoir plate 60 by means of a screw 98, so as to be kept at the ground potential. The cavity plate 22 (functioning as a first metal plate) electrically connected with the common electrode 34 and the fifth reservoir plate 64 are electrically connected with each other, so that the common electrode 34 is kept at the ground potential.

As shown in FIG. 10, however, the cavity plate 22 of the flow-path unit 4 and the fifth reservoir plate 64 of the reservoir unit 71 are jointed to each other through the filter 95, which is formed of a synthetic resin material, that is, an insulating material. If the reservoir unit 71 is just arranged on the upper surface of the flow-path unit 4, however, the cavity plate 22 and the fifth reservoir plate 64 don't come into direct contact and are electrically insulated by the insulating filter 95.

Figure 11:
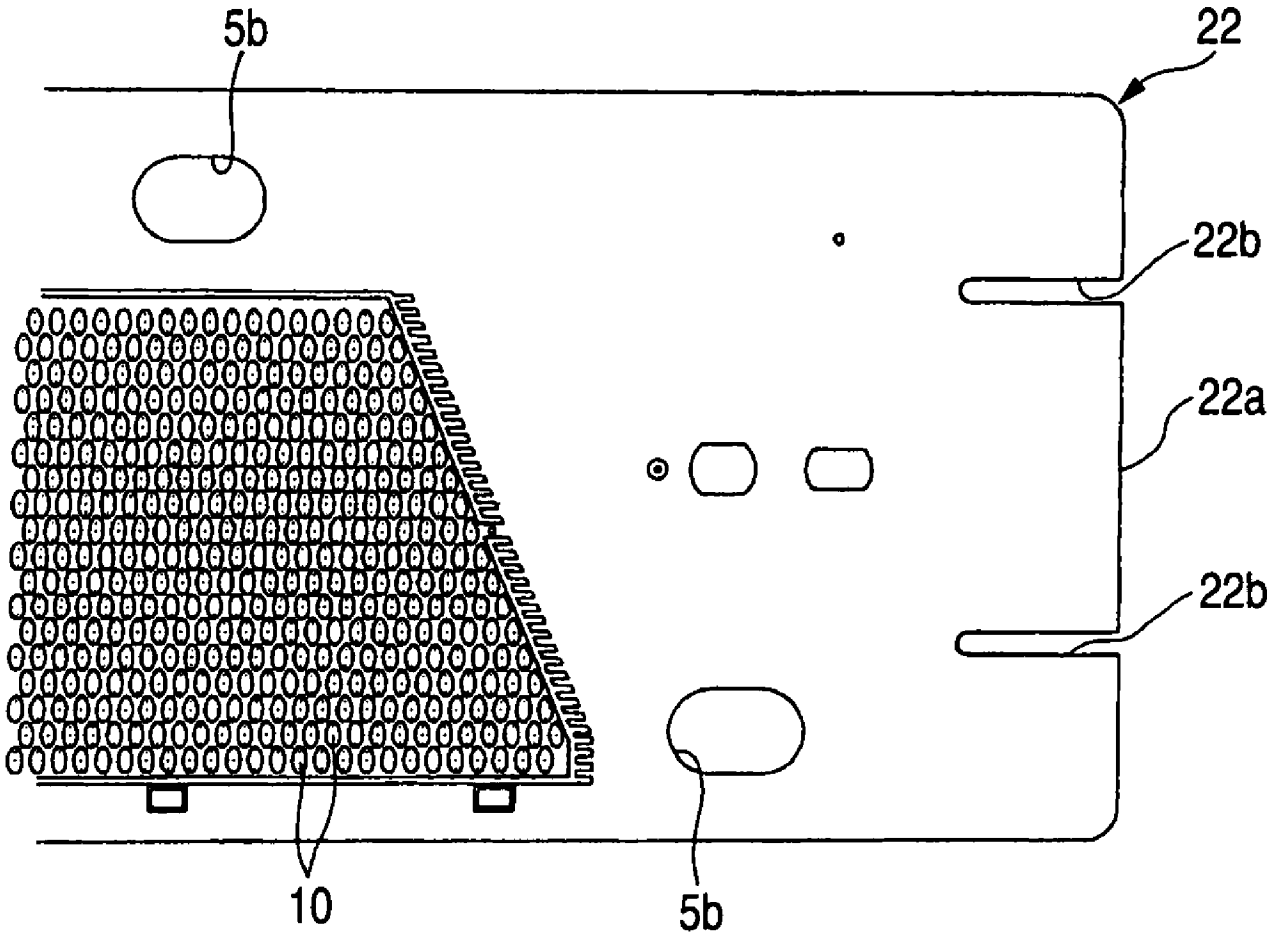
FIG. 11 is an enlarged view of an end portion of a cavity plate 22.

In the inkjet head 1 of this embodiment, therefore, two bent portions 22*a* are formed integrally with two end portions of the cavity plate 22 in the longitudinal direction (the main scanning direction), as shown in FIG. 7, FIG. 10 and FIG. 11. The bent portions 22*a* are bent within a range of elastic deformation so that their leading end portions are located above the upper surface of the filter 95. Therefore, the bent portions 22*a* are in direct contact at their leading end portions with the fifth reservoir plate 64, so that the cavity plate 22 and the fifth reservoir plate 64 are electrically connected with each other through the bent portions 22*a*. As a result, the common electrode 34 and the reinforcing electrode 67 are connected with the sub-substrates 81 through the conductive material 96, the cavity plate 22, the bent portions 22*a* and the fifth reservoir plate 64, so that the common electrode 34 and the reinforcing electrode 67 are stably kept at the ground potential. Here, since the bent portions 22*a* are bent so that their leading end portions are located above the upper surface of the filter 95, a upward biasing force is generated due to the elastic force of the bent portions 22*a* in a state where the flow-path unit 4 and the reservoir plate 6 are assembled. Therefore, the leading end portions of the bent portion 22*a* are always pressed onto the fifth reservoir plate 64 thereby to enhance the reliability of contact (i.e., the reliability of electric connection) between the bent portions 22*a* and the fifth reservoir plate 64.

Here, two slits 22*b* are formed on both sides of the bent portion 22*a* as shown in FIG. 7 and FIG. 11, respectively. Therefore, the two longitudinal end portions of the cavity plate 22 can be easily bent upward to form the bent portions 22*a*.

Figure 12:
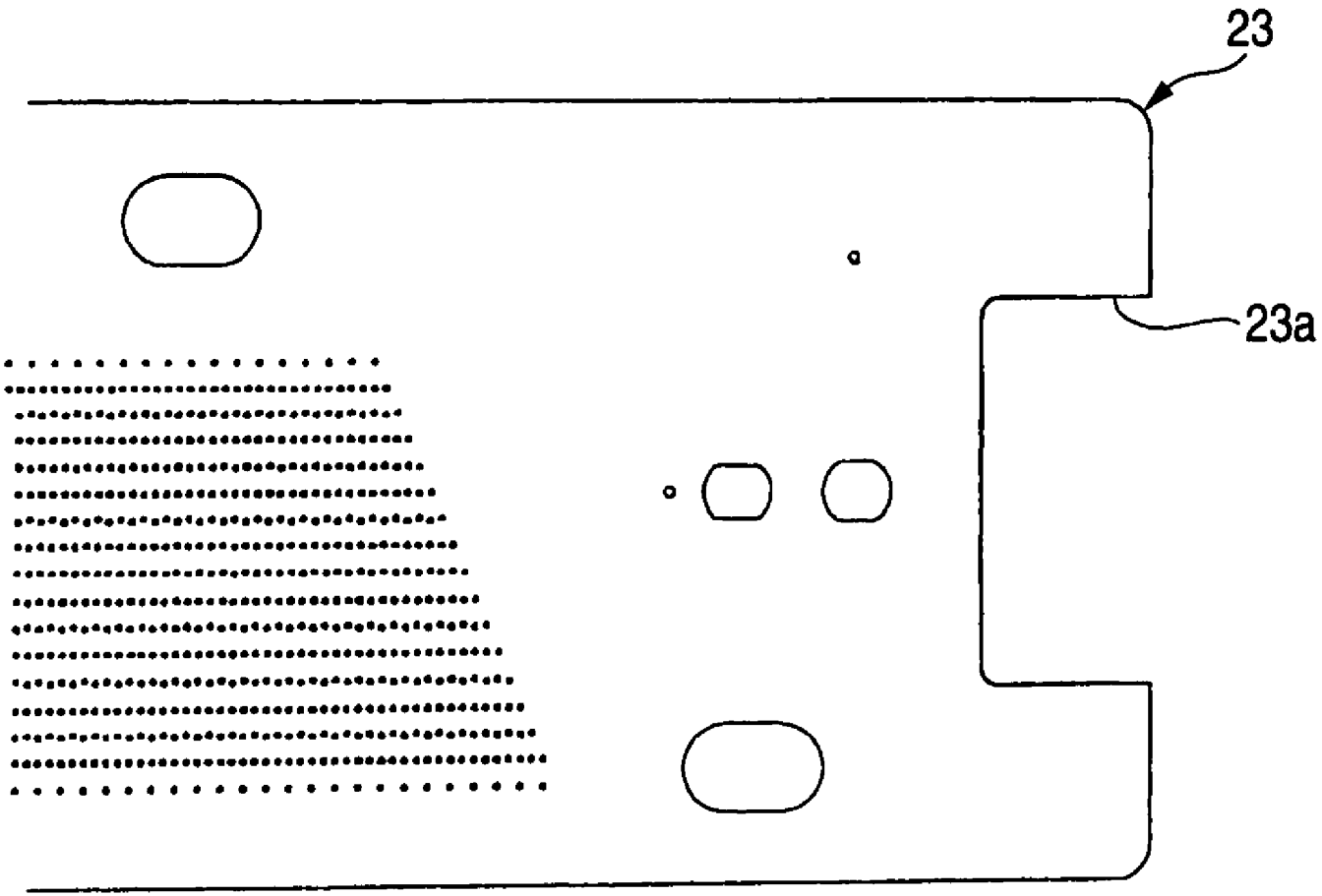
FIG. 12 is an enlarged view of an end portion of a base plate 23.

In the base plate 23 (functioning as a second metal plate) to be jointed to the lower surface of the cavity plate 22, as shown in FIG. 7 and FIG. 12, notches 23*a* are formed in the two longitudinal end portions facing the bent portions 22*a* of the cavity plate 22. When the cavity plate 22 and the base plate 23 are jointed to each other by means of an adhesive, therefore, the portions, which will become the bent portions 22*a* of the cavity plate 22, neither contact with the base plate 23 nor are contaminated by the adhesive. Moreover, the leading end of a tool can be inserted into gap between the cavity plate 22 and the base plate 23 to thereby bend the two end portions of the cavity plate 22 upward. Therefore, the bent portions 22*a* can be more easily formed.

The following effects can be attained according to the inkjet head 1 described above.

The common electrode 34 of the actuator units 21 and the cavity plate 22 of the flow-path unit 4 are electrically connected with each other through the reinforcing electrode 67 and the conductive material 96. Moreover, the cavity plate 22 and the fifth reservoir plate 64 of the reservoir unit 71 kept at the ground potential are also electrically connected with each other through the bent portions 22*a*. Even in case where the filter 95 made of the insulating material exists between the flow-path unit 4 and the reservoir unit 71, therefore, the common electrode 34 can be reliably kept at the ground potential through the flow-path unit 4 and the reservoir unit 71. In this embodiment, most parts are made of conductive materials, so that the inkjet head 1 can be kept in its entirety at the ground potential.

On the other hand, the bent portions 22*a* functioning as an electric connection portion that connects the reservoir unit 71 and the flow-path unit 4 electrically are formed integrally with the cavity plate 22. Therefore, a structure of the electric connection portions is simple. Moreover, no special conductive member is required for electrically connecting the reservoir unit 71 and the flow-path unit 4 with each other. Even if an insulating material exists therebetween, the reservoir unit 71 and the flow-path unit 4 can be electrically connected with each other merely by assembling them. Accordingly, the cost for manufacturing the inkjet head 1 can be reduced.

Here will be described modified embodiments in which various modifications are applied to the embodiment described above. The same reference numerals are assigned to components similar to those of the embodiment and the description on such components will be omitted.

Figure 13:
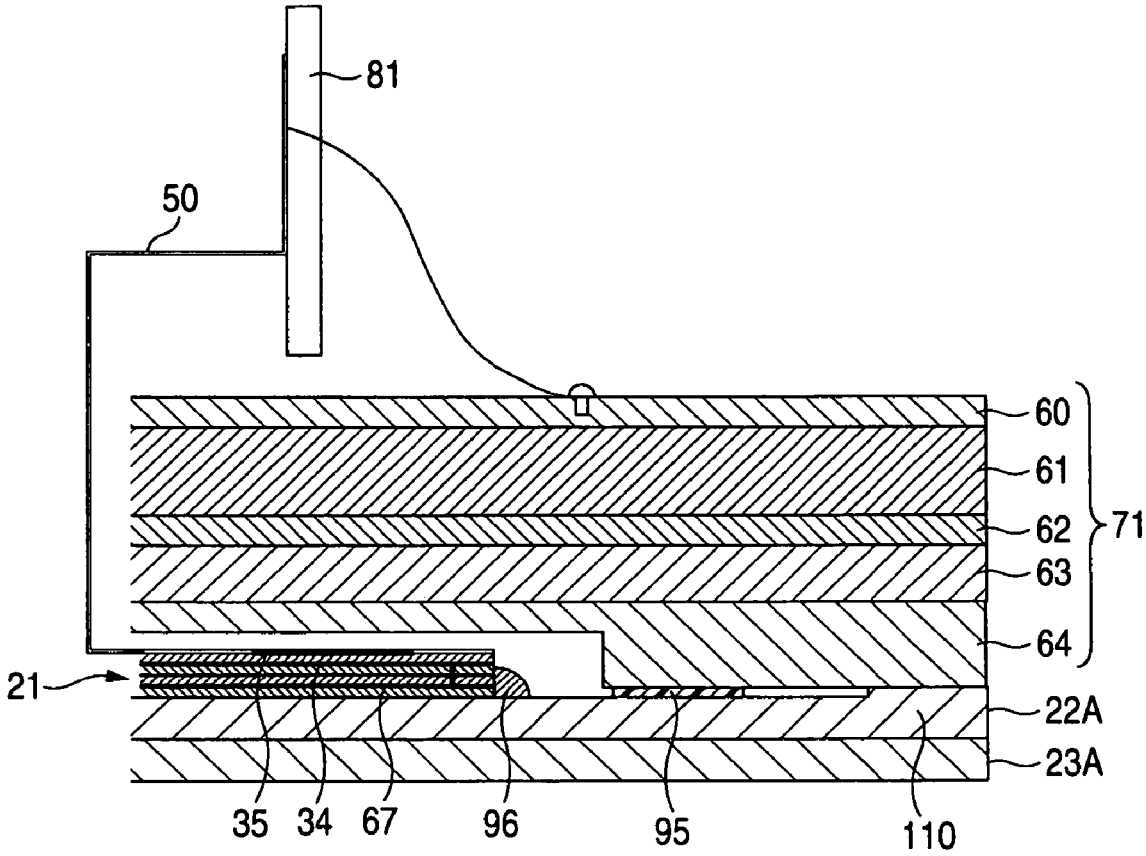
FIG. 13 is an enlarged section of a modified embodiment 1, which is a counterpart of FIG. 10.
Figure 14:
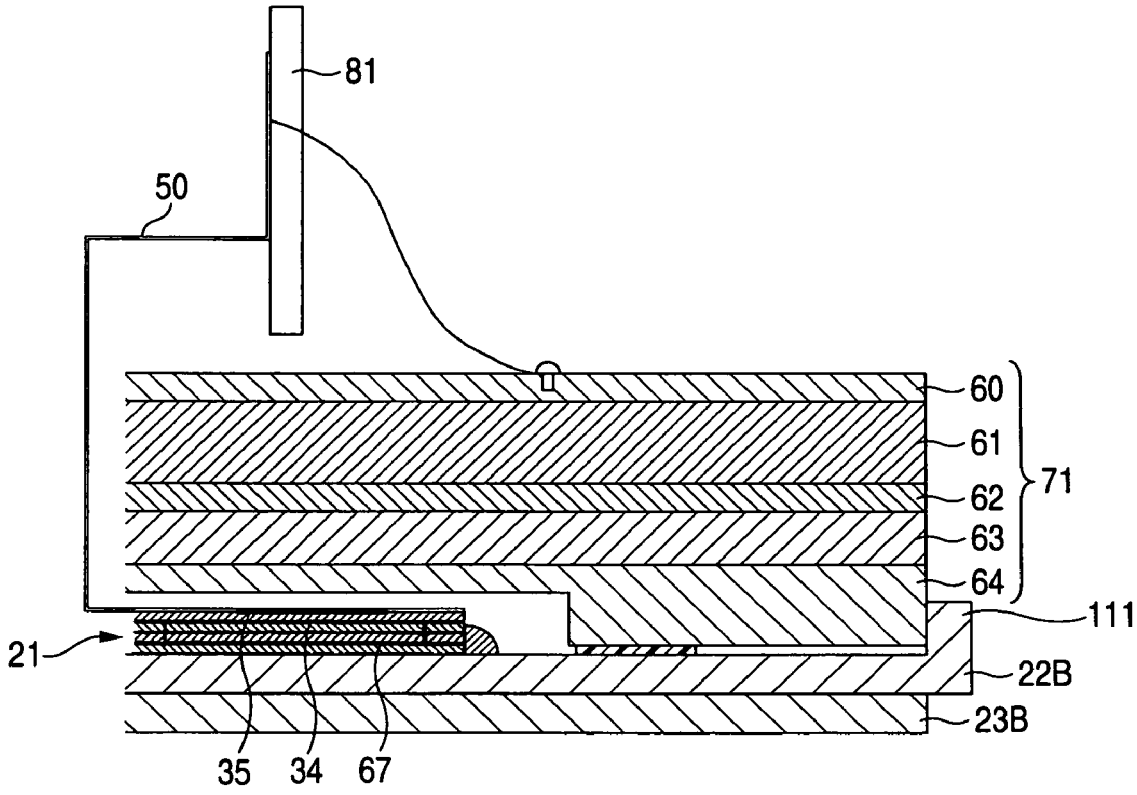
FIG. 14 is an enlarged section of a modified embodiment 2, which is a counterpart of FIG. 10.

1] Various structures other than the bent portions 22*a* of the above-described embodiment may be adopted as a structure for electrically connecting the reservoir unit with the flow-path unit. As shown in FIG. 13 (modified embodiment 1), for example, protrusions 110 protruding to substantially the same height as the upper surface of the filter 95 may be formed on the upper surface of a cavity plate 22A. The protrusions 110 of the cavity plate 22A may contact with the lower surface of the fifth reservoir plate 64 when the reservoir unit 71 is placed on the upper side of the cavity plate 22A. As shown in FIG. 14 (modified embodiment 2), alternatively, protrusions 111 protruding from the side surfaces of the reservoir unit 71 to the outer sides and further extending upward may be formed on a cavity plate 22B so that the side surfaces of the reservoir unit 71 contact with the protrusions 111. Further alternately, those bent portions or protrusions are not necessarily formed in the cavity plate, and electric connection portions, which include at least one of the bent portions, the protrusions and so on may be integrated with the reservoir unit (the fifth reservoir plate) so as to contact with the cavity plate.

Figure 15:
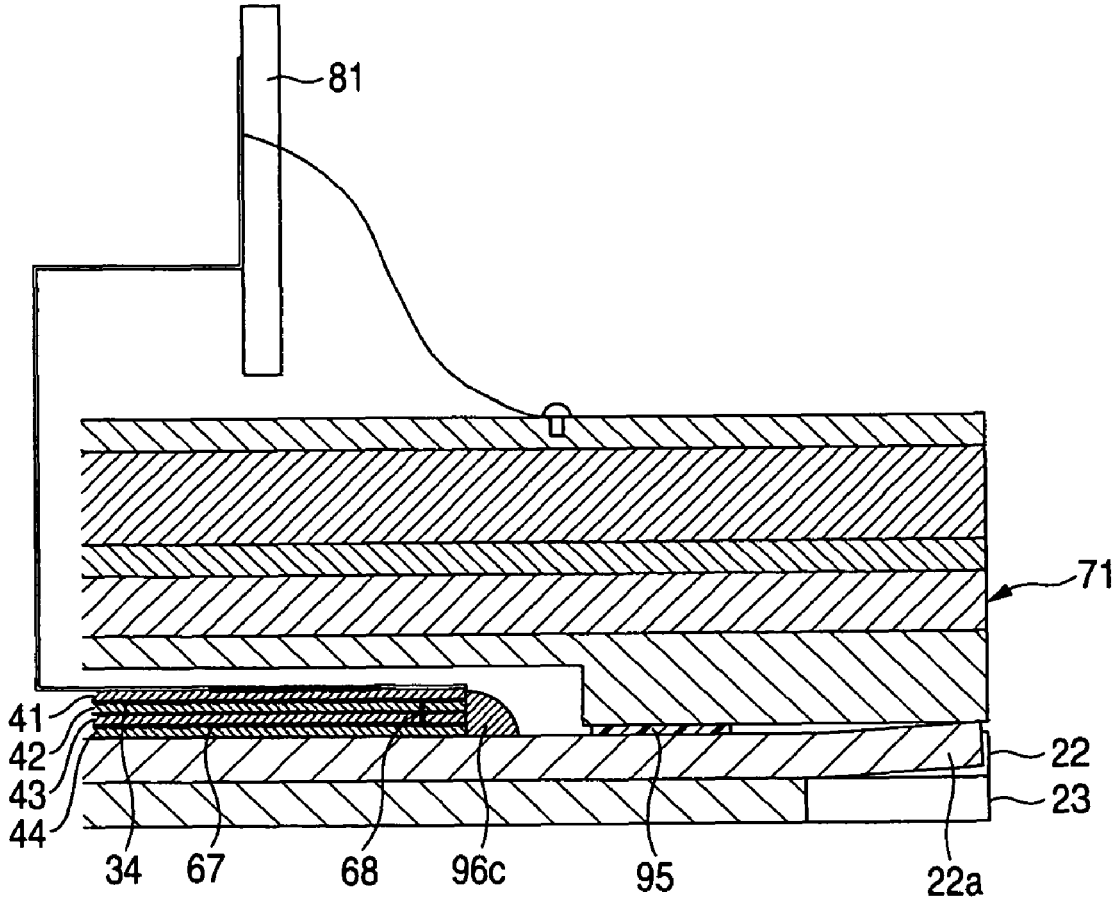
FIG. 15 is an enlarged section of a modified embodiment 3, which is a counterpart of FIG. 10.

2] The common electrode 34 and the reinforcing electrode 67 are electrically connected with each other through the conductive material 68 filling the through holes. The reliability of the electric connection between the common electrode 34 and the reinforcing electrode 67 provided by that conductive material 68 is not so high, because the conductive state may be broken when an external force is applied thereto. Therefore, as shown in FIG. 15 (modified embodiment 3), the common electrode 34 may also be exposed to the outside from the gap between the piezoelectric sheets 41 and 42, and the common electrode 34 may also be electrically connected with the reinforcing electrode 67 and the cavity plate 22 through a conductive material 96*c*, which is formed over the upper surface of the cavity plate 22 from the side surface of the piezoelectric sheet 41. In this case, the reliability of the electric connection between the common electrode 34 and the cavity plate 22 is enhanced to keep the common electrode 34 more reliably at the ground potential.

In the case where it is not necessary to reinforce the piezoelectric sheets 41 to 44 with the reinforcing electrode 67, this reinforcing electrode 67 may be omitted. In this case, the conductive material 96 electrically connects the common electrode 34 and the cavity plate 22 with each other.

Figure 16:
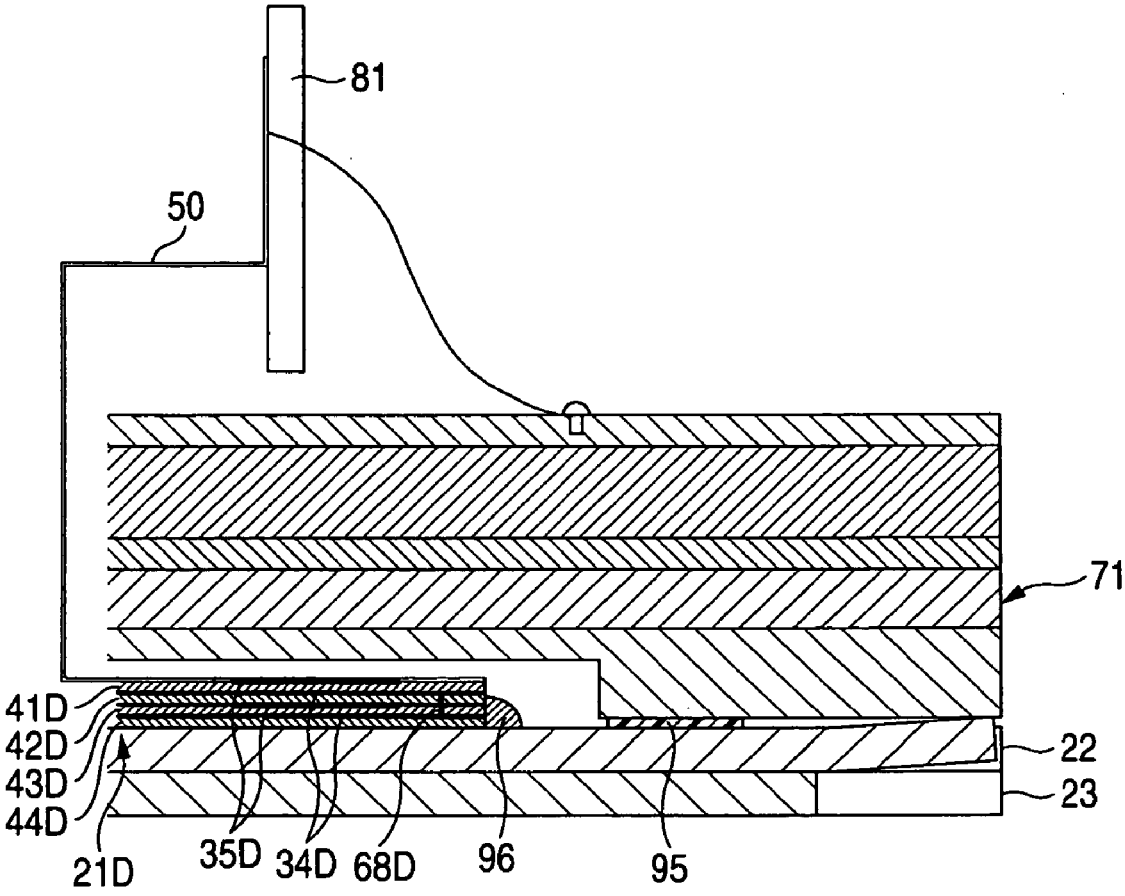
FIG. 16 is an enlarged section of a modified embodiment 4, which is a counterpart of FIG. 10.
Figure 18:
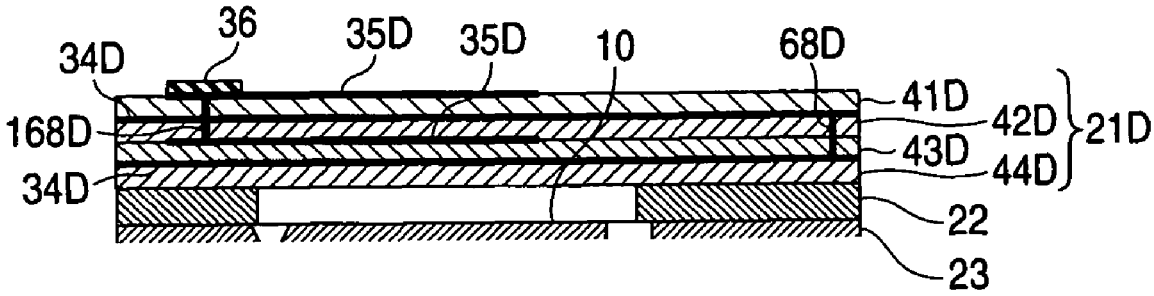
FIG. 18 is an partial enlarged view of the modified embodiment 4 shown in FIG. 16.

3] As shown in FIGS. 16 and 18 (modified embodiment 4), an actuator unit 21D may be provided with a plurality of stacked piezoelectric sheets 41D, 42D, 43D and 44D, and individual electrodes 35D and common electrodes 34D, which are alternately formed on those piezoelectric sheets 41D to 44D to sandwich the piezoelectric sheets therebetween. The individual electrodes 35D are arranged, like the individual electrodes 35 of the embodiment described above (see FIG. 9), at positions opposite to the pressure chambers 10. As shown in FIG. 18, through holes 168D are formed to pass through the piezoelectric sheets 41D, 42D and the common electrode 34D and are filled with a conductive material. The conductive material filled in one through hole 168D electrically connects corresponding one of the upper individual electrodes 35D and corresponding one of the lower individual electrodes 35D. Moreover, the common electrodes 34D are connected with each other through a conductive material 68D in the through holes extending through the piezoelectric sheets 42D and 43D. In this actuator units 21D, when the drive voltage is applied to the individual electrodes 35D, the piezoelectric sheets 41D, 42D and 43D sandwiched between the individual electrodes 35D and the common electrodes 34D individually expand/shrink in the thickness direction due to the longitudinal piezoelectric effects, so that the volume of the pressure chambers 10 is varied to apply the pressure to the ink. In the modified embodiment 4, moreover, at least the common electrode 34 located at the lowermost position is electrically connected with the cavity plate 22 through the conductive material 96. As a result, the plurality of common electrodes 34D are reliably kept at the ground potential.

Figure 17:
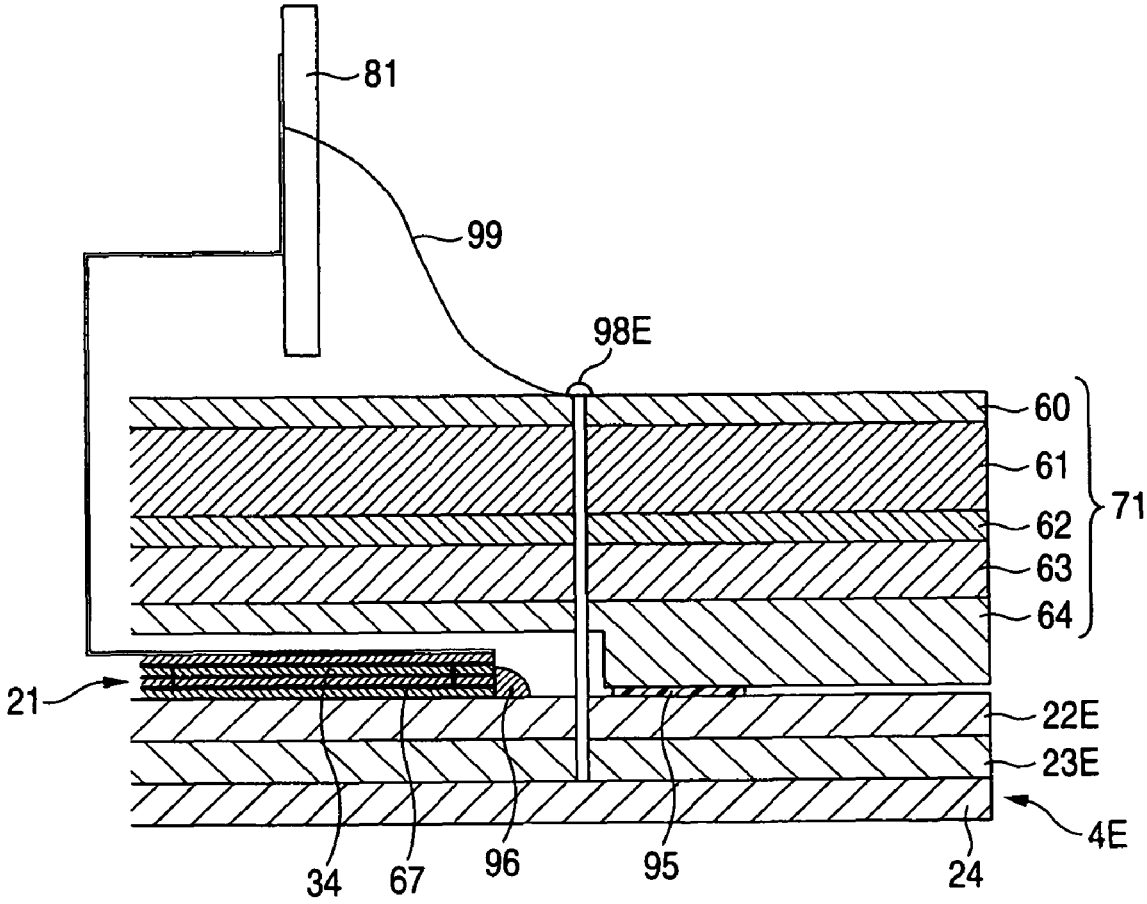
FIG. 17 is an enlarged section of a modified embodiment 5, which is a counterpart of FIG. 10.

4] The flow-path unit and the reservoir unit may be electrically connected by the conductive members, which are individually fixed onto the flow-path unit and reservoir unit (modified embodiment 5). As shown in FIG. 17, for example, a flow-path unit 4E and the reservoir unit 71 may be connected through a conductive screw 98E, which is fixed to a cavity plate 22E and a base plate 23E of the flow-path unit 4E and to the five reservoir plates 60 to 64 of the reservoir unit 71. In this case, the flow-path unit 4E and the reservoir unit 71 are reliably electrically connected with each other through the screw 98E. Therefore, the common electrode 34 of the actuator units 21 is electrically connected with the reservoir unit 71 through the flow-path unit 4E, and the common electrode 34 is reliably kept at the ground potential. Here in FIG. 17, wire 99 for electrically connecting the reservoir unit 71 and the sub-substrates 81 is fixed onto the reservoir unit 71 by the screw 98E. It is matter of course that the wire 99 may also be fixed onto the reservoir unit 71 by a member other than the screw 98E. Moreover, the flow-path unit and the reservoir unit may also be electrically connected with each other by a conductive member other than the screw 98E, for example, by a metallic wire, which is fixed at its both ends individually onto the flow-path unit and the reservoir unit.

5] The flow-path unit 4 and the reservoir unit 71 of the embodiment described above are wholly made of the metallic material. However, the invention can also be applied to the case where a flow-path unit or a reservoir unit is partially made of an insulating material and the portion made of the insulating material (the insulating material layer) is interposed between the metal portion of the flow-path unit and the metal portion of the reservoir unit. Specifically, the metal portion of the flow-path unit and the metal portion of the reservoir unit, which are separated by the insulating material layer, are electrically connected each other through either the electric connection portion integrated with at least one of those metal portions or the conductive member such as the screw fixed onto both of those metal portions. Thereby, the common electrode of the actuator units can be kept at the ground potential.

6] The embodiment and modified embodiments have been described as examples where the invention is applied to the inkjet head equipped with the piezoelectric actuator. However, the invention can also be applied to an inkjet head equipped with an actuator of another type having a portion, which may be charged. For example, the invention can also be applied to an inkjet head equipped with an actuator, which is configured so that bubbles are generated in ink by a heater, when a drive signal is fed to the drive electrode of the heater, to thereby apply ejection energy to the ink.

While a number of exemplary aspects and embodiments have been discussed above, those of skill in the art will recognize certain modifications, permutations, additions, combinations and sub-combinations thereof. It is therefore intended that the following appended claims and claims hereinafter introduced are interpreted to include all such modifications, permutations, additions, combinations and sub-combinations as are within the true spirit and scope.

What is claimed is:

1. An inkjet head comprising:

a flow-path unit comprising:

a common ink chamber; and a plurality of individual ink flow paths each of which extends from the common ink chamber to a nozzle through a pressure chamber;

a reservoir unit that reserves ink to be fed to the common ink chamber;

an actuator unit that varies a volume of the pressure chambers; and a flexible printed circuit that is electrically connected to the actuator unit and a driver IC, wherein the actuator unit comprises:

a plurality of first electrodes arranged to correspond to the plurality of pressure chambers, respectively, the first electrodes fed selectively with respective drive voltages for varying the volume of the pressure chambers; and a second electrode kept at a reference potential, one of the flow-path unit and the reservoir unit comprises a first metal portion, the other of the flow-path unit and the reservoir unit comprises a second metal portion, the metal portion of the flow-path unit and the second electrode of the actuator unit are electrically connected with each other, the first metal portion comprises a first metal plate joined to the second metal portion through an insulating material layer, and an electric connection portion, which is in direct contact with the second metal portion, is a bent portion of the first metal plate which is bent toward the second metal portion, wherein two slits are formed on both sides of the bent portion, respectively.

2. The inkjet head according to claim 1, wherein the electric connection portion is biased toward the second metal portion by an elastic force of the electric connection portion.

3. The inkjet head according to claim 1, wherein:

the first metal portion further comprises a second plate jointed to an opposite surface of the first metal plate to the second metal portion, and the second metal plate is formed with a notch at a portion facing the bent portion.

4. The inkjet head according to claim 1, wherein:

the insulating material layer is a filter having a plurality of holes formed in a substrate made of an insulating material.

5. The inkjet head according to claim 1, wherein:

the actuator unit comprises a plurality of piezoelectric sheets, which are arranged on one surface of the flow-path unit and are stacked on each other, the plurality of first electrodes are arranged opposite the pressure chambers, respectively, the second electrode is disposed over the plurality of pressure chambers, the first electrodes and the second electrode sandwich at least one of the piezoelectric sheets therebetween, the actuator unit further comprises a third electrode disposed between at least two of the piezoelectric sheets and over the plurality of pressure chambers, the third electrode being different from the second electrode, and the second electrode and the third electrode are electrically connected with each other.

6. The inkjet head according to claim 5, wherein both the second electrode and the third electrode are connected with the metal portion of the flow-path unit through a conductive material.

7. The inkjet head according to claim 1, wherein the first metal portion and the second metal portion are at the reference potential.

8. The inkjet head according to claim 1, wherein at least one of the first metal portion and the second metal portion is connected to the second electrode of the actuator unit, such that the first metal portion and the second metal portion are at the reference potential.

* * * * *